United States Patent [19]

Wessels

[11] Patent Number: 4,754,676

[45] Date of Patent: Jul. 5, 1988

[54] COMPUTER PAPER GUIDE EDGE SHEARER

[76] Inventor: William R. Wessels, P.O. Box 204, Huntsville, Ala. 35804-0204

[21] Appl. No.: 934,257

[22] Filed: Nov. 24, 1986

[51] Int. Cl.[4] ..... B26D 7/02

[52] U.S. Cl. ..... 83/452; 83/167; 83/464; 83/467 R; 83/588; 83/605

[58] Field of Search ..... 83/452, 605, 464, 467, 83/588, 167, 250, 251, 252, 228

[56] References Cited

U.S. PATENT DOCUMENTS

| | | | |
|---|---|---|---|
| 2,514,659 | 7/1950 | McClung | 83/228 |
| 3,064,512 | 11/1962 | Zurlo | 83/452 |
| 3,073,199 | 1/1963 | Yerkes | 83/588 |
| 3,089,374 | 5/1963 | Taylor | 83/588 |

*Primary Examiner*—E. R. Kazenske
*Assistant Examiner*—Scott A. Smith
*Attorney, Agent, or Firm*—C. A. Phillips

[57] ABSTRACT

A device for removing the perforated guide edges from computer paper by a shearing action. The computer paper is supported on a support plate of a first frame, with the line of perforations substantially aligned with a shearing edge provided on the distal end of the support plate. A shearing mechanism is slidably mounted for vertical movement in a second frame which is secured to the top of the first frame. The shearing mechanism includes a shear plate which is movable downward for engagement with the computer paper along the line of perforations where application of an additional force to the shear plate results in clearly shearing the perforated edges from the computer paper. Springs bias the shear plate upwardly for another shearing operation.

14 Claims, 5 Drawing Sheets

COMPUTER PAPER GUIDE EDGE SHEARER

BACKGROUND OF THE INVENTION

1. Field of the Invention

This invention relates generally to the field of paper cutters and particularly to a device for cleanly shearing the guide edge from a computer paper manuscript.

2. Background Information

A standard type of computer paper ($8\frac{1}{2}\times 11$ inches) for commercially available dot matrix and printwheel computer printers has a construction which includes the basic sheet and a guide edge. The guide edge runs parallel to the long dimension of the sheet on both sides and is connected to the sheet along a perforated line. Equispaced uniform holes are positioned down the center line of each guide edge and permit twin drive wheels to advance the sheet during printing, line feed, form feed, sheet ejection, and manual sheet advance. After the printing process has been completed, the guide edges are typically removed from the sheet by being torn or ripped by hand. Although the perforations are designed to permit clean separation, too often the printed sheet is torn. Of particular difficulty is the situation in which the printed manuscript is thicker than five sheets. Not only is the risk of tearing a printed sheet greater, but also the force necessary to achieve separation becomes too great for most people. At this time, the manuscript must be separated into smaller stacks, resulting in a time-consuming activity.

When using a machine having a cutting blade to cut through relatively large stacks of paper, the paper tends to twist and contort and becomes shredded at the edge being cut; therefore, when using a blade, extreme accurary must be exercised in order to cut the paper to the specific desired dimension.

It may be possible to use a blade to cut relatively large stacks of paper when a large amount of paper on each side of the cut is available; however, when a small amount of paper (approximately one-fourth inch) is to be trimmed off the paper sheets (as is done by the device of the present invention), a knife edge usually results in shredding of the larger side of the paper, resulting in a cumbersome and expensive operation.

The above-noted difficulties are overcome by the device of the present invention which uses the shearing edge of a shear plate to shear the computer paper along a perforated edge thereof.

Additionally, the shearing device of the present invention is safe to use in that no knife edges which may cut the operator's fingers are used. Also, a pressure plate is provided to retain the stack of papers in place for the shearing operation, thus keeping the operator's fingers away from the shearing mechanism.

SUMMARY OF THE INVENTION

In accordance with this invention, a computer paper guide edge trimming device is provided which will cleanly remove the guide edges of a manuscript having one or more pages. The removal is accomplished in a shearing action. The device includes a first frame having a support plate secured thereon for supporting the computer paper manuscript during the shearing operation. A shearing mechanism is supported by a second frame for vertical movement and includes a load member and a shear plate rigidly coupled together in spaced relation by coupling means. The load member and the coupling means are slidably supported in the second frame and coupled to the shear member for downward movement thereof responsive to a downward force being applied to the load member. The shear plate engages the paper for the shearing operation. A plurality of downwardly extending alignment guides on the shear plate seats the shear plate along the computer paper guide edge to assure a clean cut along the guide perforations of the paper. Return springs bias the load plate upwardly after the shearing operation. As a further feature, a tray is slidably carried in the first frame to collect the cuttings.

DESCRIPTION OF THE PREFERRED EMBODIMENTS

Figure 2:
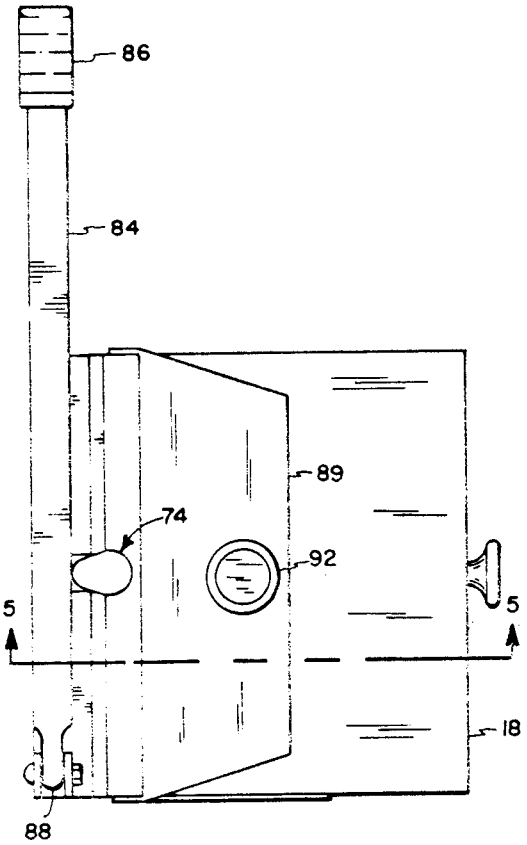
FIG. 2 is a top view of the device of FIG. 1.
Figure 1:
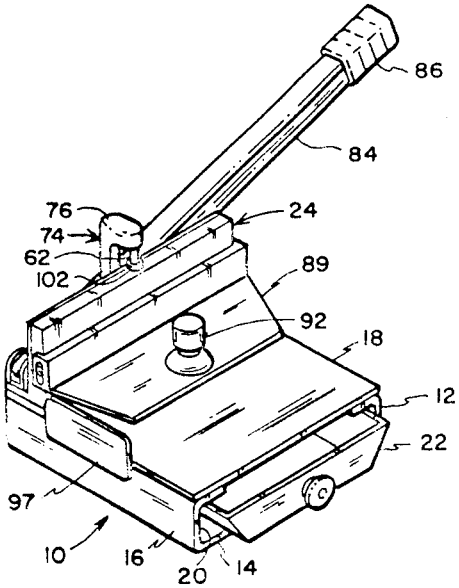
FIG. 1 is a pictorial view of one embodiment of the computer paper guide edge shearer of the present invention.
Figure 3:
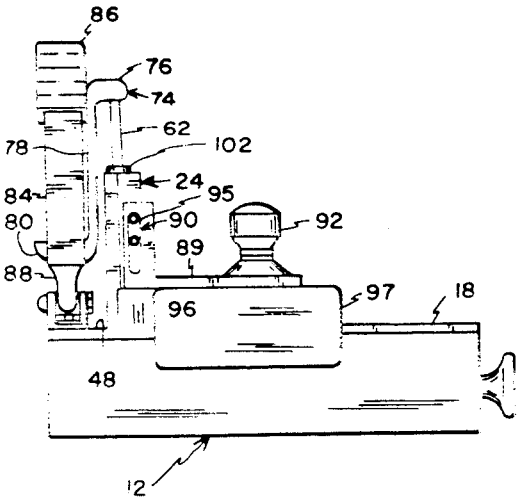
FIG. 3 is an elevational view of the device of FIG. 1.
Figure 4:
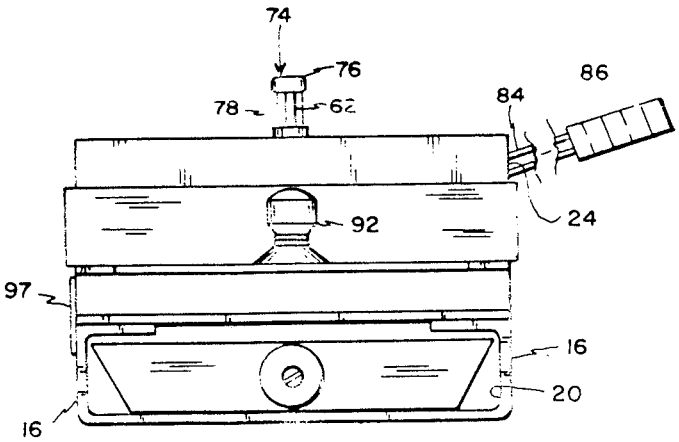
FIG. 4 is a front view of the device of FIG. 1.

As seen in FIG. 1, the computer paper trimming device 10 of the present invention includes a first frame or formed base 12 having a bottom 14 provided with a pair of spaced, upwardly extending sides 16 having a support plate 18 secured thereto. Base plate 12 forms an opening 20 in which a cutting tray 22 is slidably carried. A second frame 24 is secured to the top of frame 12 and houses a shearing mechanism 26. Together, the base 12, including support plate 18, acts as a reaction mass during the shearing operation and as a support for the document being trimmed.

As more clearly seen in FIGS., 5, 6, and 8, frame 24 includes a face plate 28 and a back plate 30 disposed for secured relation. Face plate 28 includes upper and lower rearwardly extending surfaces 32 and 34 and sides 36 and 38, respectively. Back plate 30 includes upper and lower forwardly extending surfaces 40 and 42 and sides 44 and 46, respectively. An opening 35 is provided in surfaces 32 and 40. The sides and upper and lower surfaces of the face and back plates are disposed for mating relation responsive to assembly of the frame. Back plate 30 further includes a flanged section 48 for securing the frame assembly to base 12. Openings 47 are provided through surfaces 34 and 42.

Figure 5:
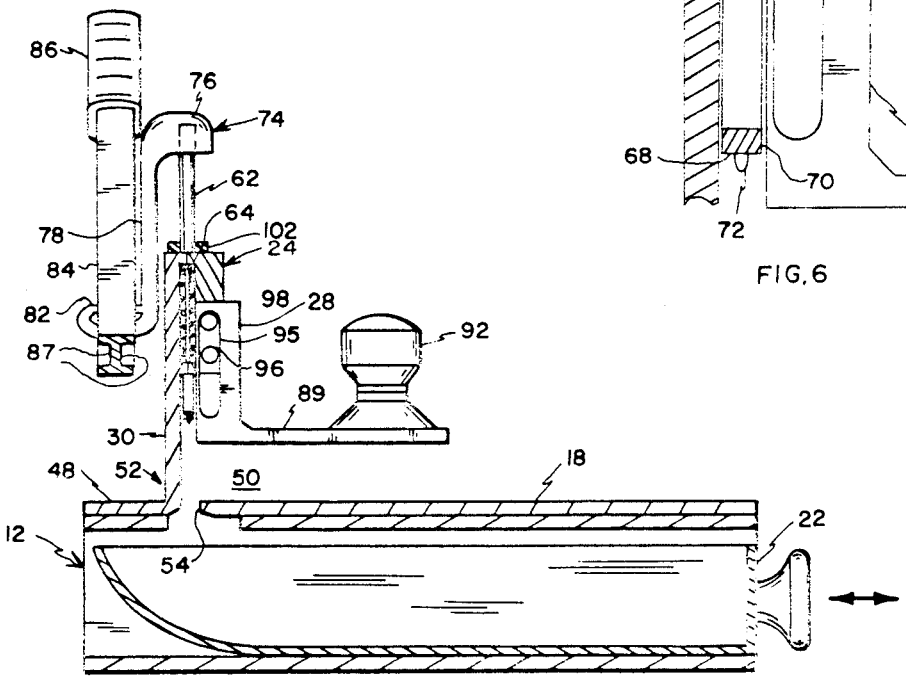
FIG. 5 is a sectional view taken along line 5—5 of FIG. 2.

A transverse opening 50 (FIG. 5) is formed between back plate 30 and the lower stop portion 52 thereof and the shearing edge 54 at the distal end of support plate 18 to allow the cuttings to fall into tray 22. Lower portion 52 of back plate 30 forms a stop against which the paper abuts when it is placed on plate 18 for a cutting operation.

Figure 9:
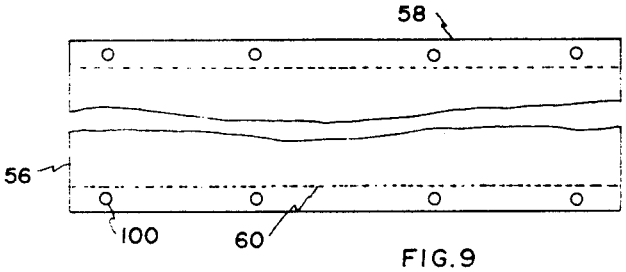
FIG. 9 is a plan view of a sheet of computer paper which is sheared by the device of the present invention.

FIG. 9 illustrates the computer paper 56 having guide edges 58 thereon and perforations 60 between the main section of computer paper 56 and guide edges 58. To remove the guide edges from the computer paper, the shearing mechanism 26 is disposed for vertical movement in frame 24 and for engaging the computer paper along perforations 60 to shear the guide edges at the perforations.

The shearing mechanism includes a main shear rod 62 (FIGS. 5, 6, and 8) which is coupled directly to and extends upwardly from a load plate 64 and out of the top of frame 24 through opening 35. A plurality of secondary shear rods 66 (four being shown in FIG. 7) extend downwardly from load plate 64. A shear plate 68 having a shearing edge 70 is secured to rods 66 at the ends thereof, and a plurality of guide pins 72 (four being shown) depend from plate 68. Shear plate 68 is positioned below surfaces 34 and 42 after assembly of plates 36 and 46 and shearing edge 70 is disposed in substantially parallel relation with shearing edge 54.

To apply the shearing force to the shear plate, a pull-down yoke 74 (FIGS. 1, 3, 5, and 7) is in engagement with main shear rod 62 for downward movement thereof. Yoke 74 includes an upper cap portion 76, an intermediate section 78, and a lower section 80. Cap portion 76 is in engagement with main shear rod 62, and lower section 80 includes a pair of inwardly extending lip portions 82.

To impart downward movement to the yoke, a lever 84 having a handle 86 thereon is pivotally secured at one end 88 to lower flanged portion 48 of frame 24. Lever 84 is provided with grooves 87 on opposite sides thereof in which lip portions 82 of yoke 74 are seated for slidable movement therein. The pull-down yoke allows for angular displacement at its pinned connection to the lever and its rounded capped mounting on the main shear rod at its upper end 76.

To retain the manuscript in secured relation for the shearing operation, a pressure flange 89 is mounted on frame 24 for movement up and down the frame on a track-roller assembly 90. A handle 92 is secured to the pressure flange. Pressure flange 89 includes a pair of upstanding sides 99 and 94 (FIG. 8) having a cut-out therein which forms the track 95 for the track-roller assembly 90. Rollers 96 are secured to the sides 36 and 38 of front plate 28 and extend into the track 95 to permit vertical movement of the pressure plate on the frame.

Figure 6:
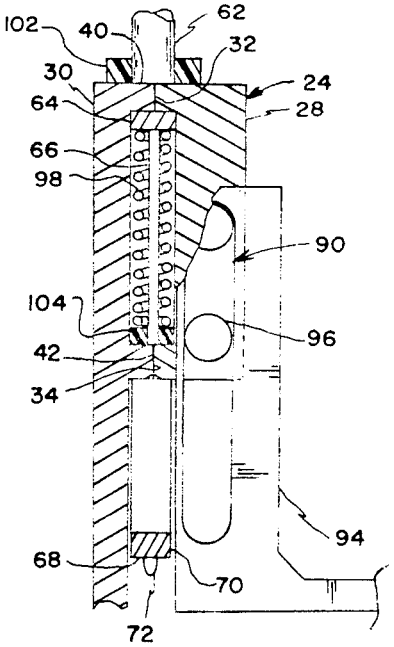
FIG. 6 is an enlarged elevational sectional view of the shearing mechanism shown in FIG. 5. The view is enlarged to more clearly show the details of the shearing mechanism.

To return the shearing mechanism to its original position after a cutting operation, a plurality of return springs 98 are mounted on shearing mechanism 26 for biasing the shearing mechanism upwardly after a cutting operation. In one embodiment, return springs 98 are mounted around secondary shear rods 66, with the ends of the springs abutting the upper flanges 32 and 40 and lower flanges 34 and 42 of frame 24 (FIG. 6). If desired, return springs 98 may be positioned around a pair of rods 100 extending between load plate 64 and shear plate 68 as shown in phantom lines in FIG. 7.

In operation, the manuscript is mounted on plate 18 and accurately positioned by a guide strip 97. The manuscript is secured in place by pressure plate 89, with perforations substantially aligned along shearing edge 54 of plate 18. The operator then pushes down the lever 84, gripping it by the handle 86. The lever transmits the downward applied force to pull-down yoke 74, which in turn transmits the downward applied force to the main shear rod 62, load plate 64, secondary shear rods 66, and shear plate 68. The alignment guide pins 72 are seated in holes 100 of the computer paper and aligns the shearing edge of shear plate 68 along the perforations 66 of paper 56 (FIG. 9). All the transmitted force from the lever, less the force required to overcome return springs 98 and friction, is applied along the guide edge perforations 60, resulting in a clean separation of the computer paper guide edge at the perforation. The shearing mechanism is returned to the upstart position by return springs 98.

Figure 7:
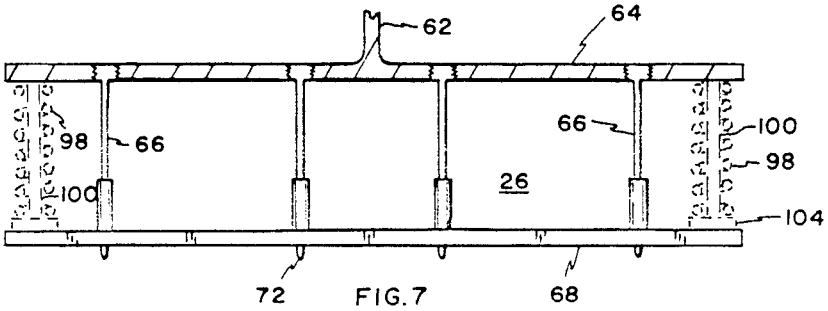
FIG. 7 is an elevational view, partially in section, of the load member and shear rods for connecting the load member to the shear plate of the device of the present invention. Alignment pin guides are shown extending downwardly from the shear plate.
Figure 8:
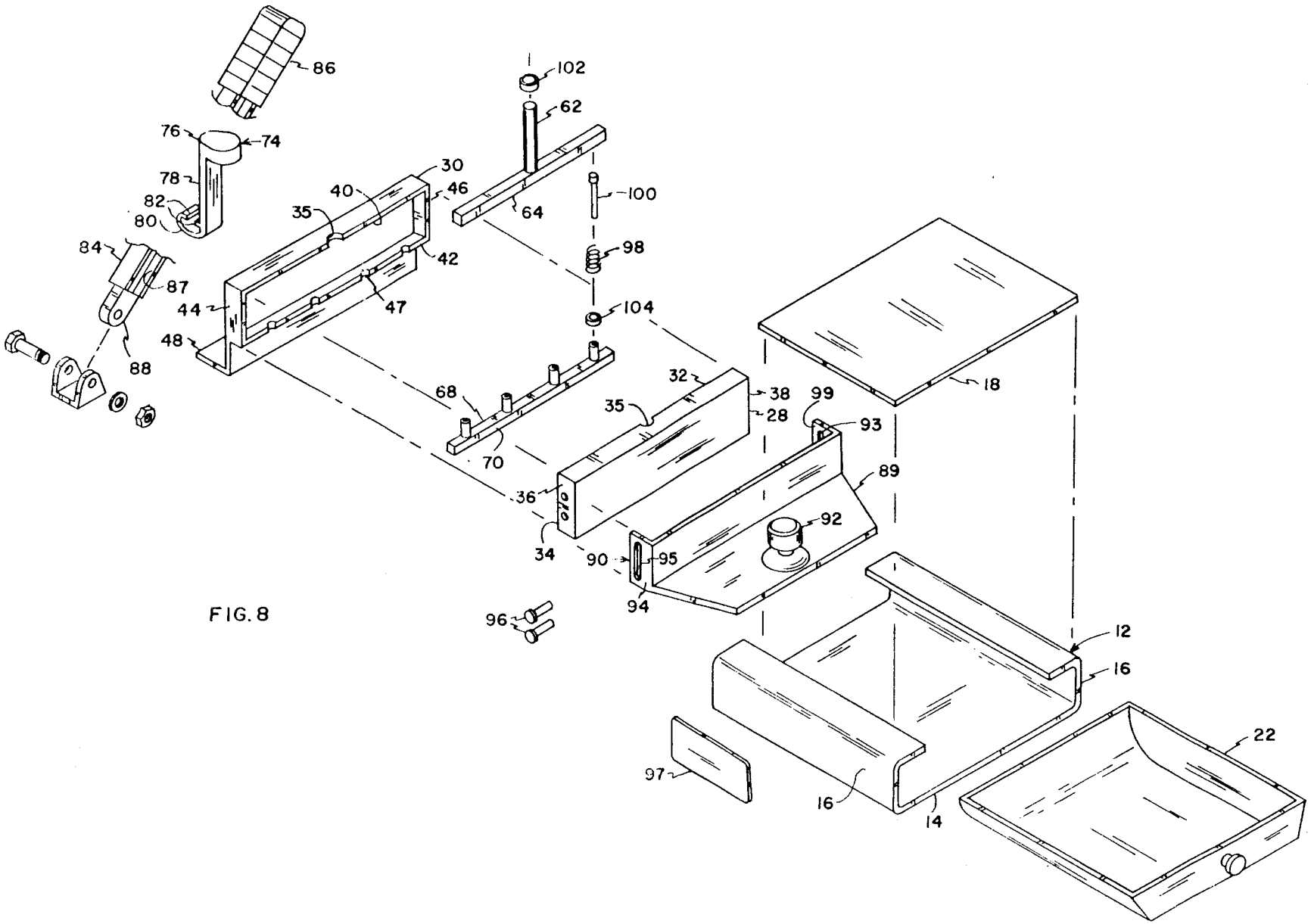
FIG. 8 is an exploded pictorial view of the device of the present invention. The view is exploded to illustrate the manner in which the device is assembled.
Figure 10:
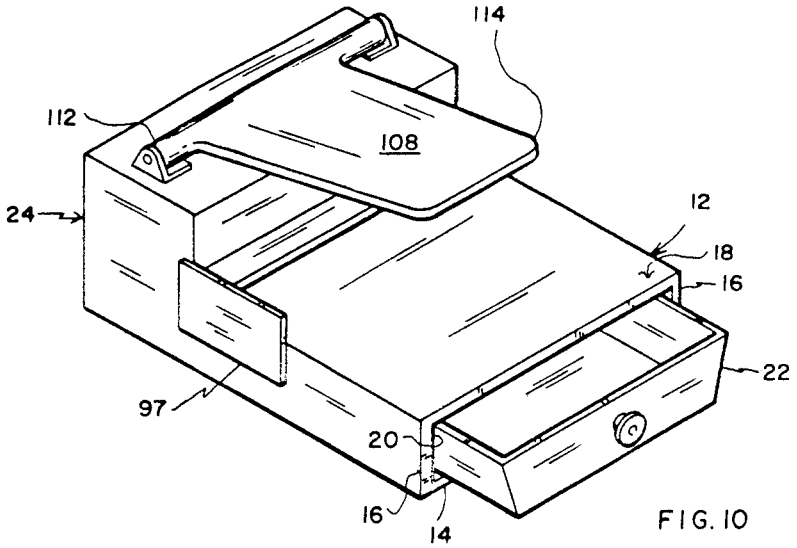
FIG. 10 is a pictorial view of another embodiment of the computer paper guide edge shearer of the present invention.
Figure 11:
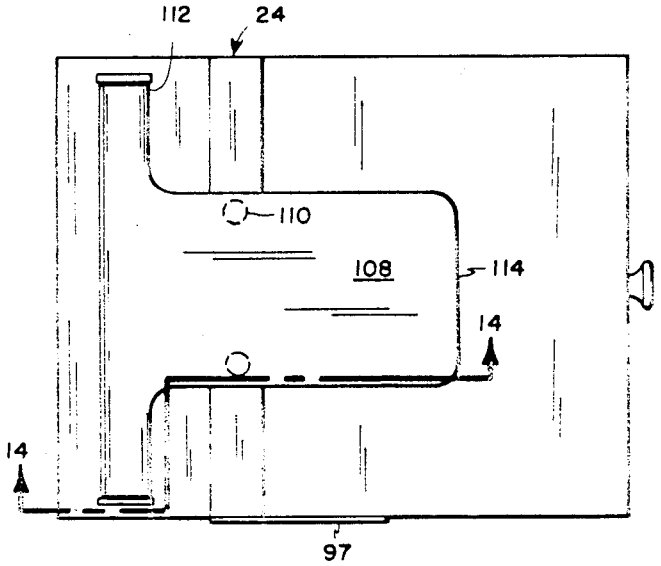
FIG. 11 is a top view of the device of FIG. 10.
Figure 12:
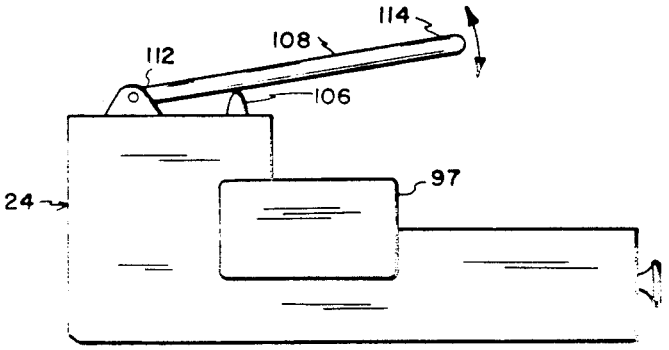
FIG. 12 is an elevational view of the device of FIG. 10.
Figure 13:
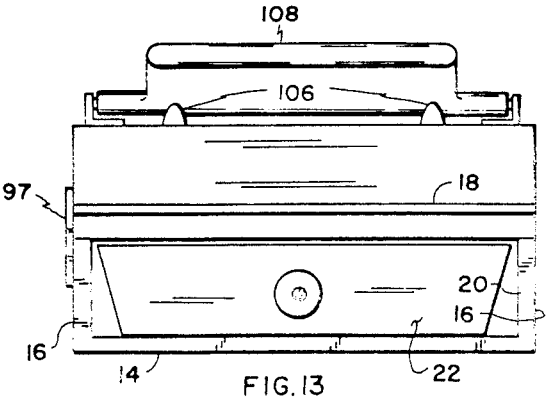
FIG. 13 is a front elevational view of the device of FIG. 10.
Figure 15:
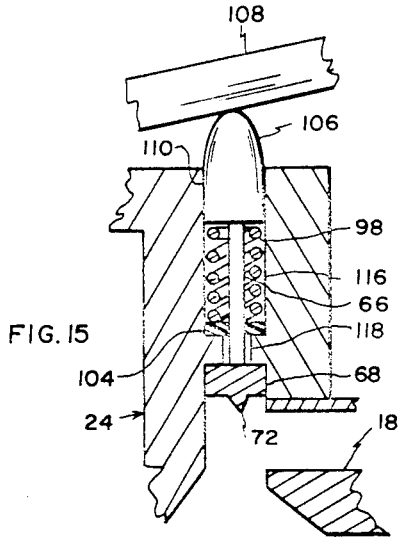
FIG. 15 is an enlarged sectional view of the shearing mechanism shown in FIG. 14.
Figure 14:
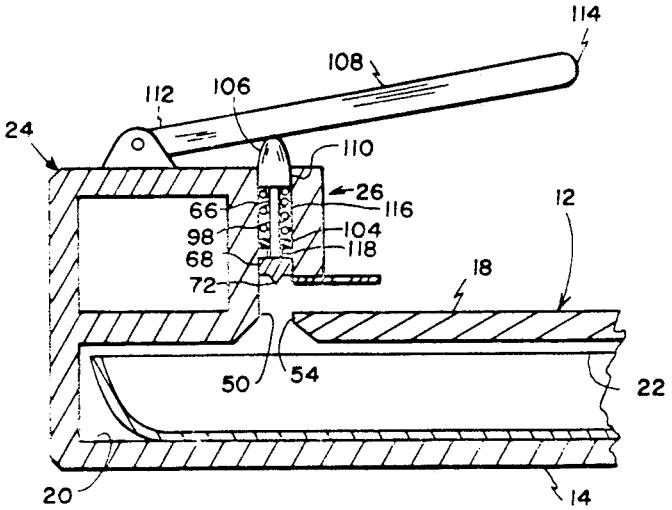
FIG. 14 is a sectional view taken along line 14—14 of FIG. 11.

To prevent bottoming out of the pull-down yoke on the frame 24 of the shear mechanism, grommet 102 is positioned around main shear rod 62 on the top of frame 24 (FIG. 1). A secondary protection from bottoming out is provided by rubber grommets 104 mounted around the bottom of secondary shear rods 66 (FIG. 6) or rod 100 (FIG. 7).

Another embodiment of the present invention is shown in FIGS. 10–15 wherein like numerals refer to like parts. In this embodiment, the device is designed for shearing a smaller computer paper manuscript, that is, a manuscript comprised of fewer computer papers. The device includes a frame or base 12 having a bottom 14 with a pair of spaced, upwardly extending sides 16 and a support plate 18. Frame 12 forms an opening 20 in which a cutting tray 22 is slidably carried. A frame 24 is provided on the top of frame 12.

Figure 16:
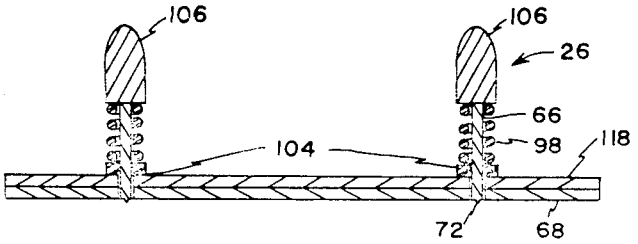
FIG. 16 is an elevational view, partially in section, of the load member and shear rods for connecting the load members to the shear plate. Alignment pin guides are shown extending downwardly from the shear plate.

The shearing mechanism 26 includes a pair of load members 106 (FIGS. 14, 15, and 16), secondary shear rods 66, springs 98, shear plate 68, and guide pins 72, all assembled in the manner described above except for load members 106. In this embodiment, the shearing mechanism utilizes two secondary shear rods 66 which are engaged by a lever 108 through the load members 106 which are secured to and extend through openings 110 in the top of frame 24. Lever 108 is pivotally secured at its ends 112 to the top of frame 24 for upward and downward movement. The lever 108 includes a forwardly extending portion 114. In this embodiment, the frame includes a guide track 116 in which the shear rods 66 and springs 98 are movably mounted. Springs 98 are seated between the lower surface of load members 106 and a flanged portion 118 of the frame. Grommets 104 are positioned around the bottoms of the springs to prevent bottoming out.

The document is positioned by the use of guide strip 97. The lever is depressed by pushing down on portion 114 with the palm of the hand. The lever applies force directly to the load members 106 which transmit the force directly to the shear plate or strip 68 through members 106 and rods 66. Shear plate 68 transmits all of the force aplied to the lever, less the force required to overcome the springs 98 and friction, to the guide edge along the perforation line of the computer paper.

What is claimed is:

1. A device for removing the perforated guide edges from computer papers comprising:

a first frame;

a support plate secured to the top of said first frame for support of said computer paper thereon, said support plate having a first elongated shearing edge on the distal end thereof;

a second frame secured to said first frame, said second frame having an upstanding portion in predetermined spaced relation with said distal end of said support plate to form a transverse opening therebetween, said upstanding portion of said second frame defining a stop to control the positioning of said computer paper so that the perforations along said guide edges of said computer paper are substantially precisely aligned along said shearing edge of said support plate;

a shearing mechanism mounted for vertical movement with respect to said second frame, said shearing mechanism including a load member, a shear plate disposed in spaced relation with said load member, coupling means for rigidly securing said load member and said shear plate, said shear plate having a second elongated shearing edge thereon, said second shearing edge disposed in substantially parallel relation with said first shearing edge for aligned relation and simultaneous engagement with a line of perforations along the guide edges of said computer paper for simultaneous and even distribution of the shearing load along said line of perforations;

alignment pins secured to said shear plate and extending downwardly therefrom;

means for applying a downward force to said load member for engagement of said alignment pins in equispaced holes provided along the perforated edges of said computer paper and for engagement of said shear plate along said perforated edge for the shearing operation; and spring means carried between said second frame and said load member for biasing said shearing mechanism in a substantially straight vertical path to an upward position responsive to the shearing operation.

2. A device as set forth in claim 1 including securing means for firmly holding said computer paper on said support plate with said support perforations in aligned position with said first shearing edge, said securing means including a plate movably secured to said face plate of said frame, said plate having a flange extending therefrom for firm engagement with said computer paper, said flange having a handle thereon, said plate including a pair of side members having cut-out portions thereon, rollers secured on the sides of said face plate and extending into said cut-out portions, said cut-out portions and said rollers forming a track and roller assembly.

3. A device for removing the perforated guide edges from computer papers comprising:

a first frame;

a support plate secured to the top of said first frame for support of said computer paper thereon, said support plate having a first elongated shearing edge on the distal end thereof;

a second frame secured to said first frame, said second frame having an upstanding portion in predetermined spaced relation with said distal end of said support plate to form a transverse opening therebetween, said upstanding portion of said second frame defining a stop to control the positioning of said computer paper so that the perforations along said guide edges of said computer paper are substantially precisely aligned along said shearing edge of said support plate;

securing means secured to said second frame for reciprocal movement thereon for firmly holding said computer paper on said support plate with said perforations in aligned position with said shearing edge of said support plate;

a shearing mechanism mounted for vertical movement with respect to said second frame, said shearing mechanism including a load member, a shear plate disposed in spaced relation with said load member, coupling means for rigidly securing said load member and said shear plate, said shear plate having a second elongated shearing edge thereon, said second shearing edge disposed in substantial parallel relation with said first shearing edge for aligned relation and simultaneous engagement with a line of perforations along the guide edges of said computer paper for simultaneous and even distribution of the shearing load along said line of perforations;

alignment pins secured to said shear plate and extending downwardly therefrom;

means for applying a downward force to said load member for engagement of said alignment pins in equispaced holes provided along the perforated edges of said computer paper and for engagement of said shear plate along said perforated edge for the shearing operation; and spring means carried between said second frame and said load member for biasing said shearing mechanism in a substantially straight upward path to an upward position responsive to the shearing operation.

4. A device as set forth in claim 1 including guide means secured adjacent the edge of said support plate to guide said computer paper into the desired position on said support plate.

5. A device as set forth in claim 4 wherein said coupling means are rods secured between said load member and said shear plate in equidistantly spaced relation.

6. A device as set forth in claim 5 wherein said spring means includes a single spring carried around each rod, one end of each spring abutting said load member, and the other end of said spring abutting said frame.

7. A device as set forth in claim 1 wherein said load member is a plate extending across said equidistantly spaced rods.

8. A device as set forth in claim 7 wherein said second frame includes upper and lower flanged portions, said load member, said springs, and said rods being movably mounted in said frame with said lower portion of each rod extending through said lower flanged portion of said housing, said shear plate being secured to said lower extending portion of said rods, and said spring abutting said lower flanged portion of said frame.

9. A device as set forth in claim 8 wherein said load member is provided with an upper extending portion which extends above said second frame, and said means for applying a downward force to said load member comprises a yoke having an upper cap section in engagement with said upper extending portion of said load member, said yoke having a lower portion provided with inwardly extending lips and an intermediate section between said cap and said lower section, a lever having grooved surfaces on the sides thereof to receive said inwardly extending lips of said yoke, said lever having a first end pivotally secured to said first frame and a second end having a handle thereon.

10. A device as set forth in claim 9 wherein said securing means includes a plate movably secured to said face plate of said frame, said plate having a flange extending therefrom for firm engagement with said computer paper, said flange having a handle thereon, said plate including a pair of side members having cut-out portions thereon, rollers secured on the sides of said face plate and extending into said cut-out portions, said cut-out portion and said rollers forming a track and roller assembly.

11. A device as set forth in claim 8 wherein said first frame is provided with a lower base portion having an opening therethrough and a tray positioned in said opening of said base portion beneath said transverse opening formed by said support plate and said upstanding portion of said second frame to catch the cuttings from said computer paper.

12. A device as set forth in claim 1 wherein said coupling means is a pair of rods having upper and lower ends, said rods disposed in spaced relation on said shear plate, said lower end of said rods being secured to said shear plate, said upper end of each said rod being secured to said load member, said load member extending upwardly through said second frame.

13. A device as set forth in claim 12 wherein said means for applying a downward force to said load members includes a flat plate pivotally secured to said frame, said plate disposed in engagement with said load members for applying a downward force thereto.

14. A device as set forth in claim 13 wherein said first frame is provided with a lower base portion having an opening therethrough and a tray positioned in said base portion beneath said transverse opening formed by said support plate and said upstanding portion of said second frame to catch the cuttings from said computer paper.

* * * * *